US010519918B2

(12) United States Patent
Radhakrishnan et al.

(10) Patent No.: US 10,519,918 B2
(45) Date of Patent: Dec. 31, 2019

(54) ARRANGEMENT OF SOLENOID ASSEMBLY WITH AN ELECTRONIC SWITCH FOR A STARTER MOTOR

(71) Applicant: COMSTAR AUTOMOTIVE TECHNOLOGIES PVT LTD, Tamil Nadu (IN)

(72) Inventors: Muruganandam Radhakrishnan, Tamil Nadu (IN); Thulsirajan Ganesan, Tamil Nadu (IN); Sathishkumar Manoharan, Tamil Nadu (IN); Sarankumar Ramakrishnan, Tamil Nadu (IN); Govindhan Krishnan, Tamil Nadu (IN)

(73) Assignee: COMSTAR AUTOMOTIVE TECHNOLOGIES PVT LTD, Tamil Nadu (IN)

( * ) Notice: Subject to any disclaimer, the term of this patent is extended or adjusted under 35 U.S.C. 154(b) by 0 days.

(21) Appl. No.: 15/566,512

(22) PCT Filed: Apr. 12, 2016

(86) PCT No.: PCT/IN2016/050107
§ 371 (c)(1),
(2) Date: Oct. 13, 2017

(87) PCT Pub. No.: WO2016/166770
PCT Pub. Date: Oct. 20, 2016

(65) Prior Publication Data

US 2018/0119663 A1 May 3, 2018

(30) Foreign Application Priority Data

Apr. 13, 2015 (IN) ..... 1909/CHE/2015

(51) Int. Cl.
*F02N 11/08* (2006.01)
*F02N 15/06* (2006.01)
(Continued)

(52) U.S. Cl.
CPC ..... *F02N 11/0855* (2013.01); *F02N 11/087* (2013.01); *F02N 15/067* (2013.01);
(Continued)

(58) Field of Classification Search
CPC ..... F02N 11/06; F02N 11/063; F02N 11/067; F02N 11/08; F02N 11/0844; F02N 11/0855; F02N 11/087
(Continued)

(56) References Cited

U.S. PATENT DOCUMENTS 4,901,690 A * 2/1990 Cummins ..... F02N 11/10 123/179.1
5,622,148 A * 4/1997 Xue ..... F02N 11/0851 123/179.25
(Continued)

FOREIGN PATENT DOCUMENTS

EP 0751545 A1 1/1997
EP 2508747 A1 10/2012
(Continued)

OTHER PUBLICATIONS

International Search Report, PAT/IN2016/050107, dated Sep. 20, 2016.

*Primary Examiner* — John Kwon
*Assistant Examiner* — Johnny H Hoang
(74) *Attorney, Agent, or Firm* — Porzio Bromberg & Newman P.C.

(57) ABSTRACT

A starter for starting an engine in a vehicle, which includes a motor and an output shaft that rotates by receiving torque from the motor. The starter also includes a pinion movable
(Continued)

body that includes a pinion for transmitting the torque of the motor to a ring gear of the engine. The pinion movable body is provided on an outer circumference of the output shaft integrally with the pinion in a manner allowing movement along an axial direction. The solenoid assembly consist of two divisions, one for to pull up the drive in the solenoid and the other to activate the starter motor by energizing the electronic circuit.

3 Claims, 7 Drawing Sheets

(51) Int. Cl.

| | |
|---|---|
| *F02N 15/00* | (2006.01) |
| *F02N 15/02* | (2006.01) |
| *F02N 15/04* | (2006.01) |
| *H01H 51/06* | (2006.01) |

(52) U.S. Cl.
CPC ..... *F02N 15/006* (2013.01); *F02N 15/022* (2013.01); *F02N 15/046* (2013.01); *F02N 2011/0874* (2013.01); *H01H 51/065* (2013.01)

(58) Field of Classification Search
USPC ..... 123/179.1, 185.14, 185.4; 74/7 A, 7 C, 74/7 E, 7 R, 8; 335/120, 126, 131, 202
See application file for complete search history.

(56) References Cited

U.S. PATENT DOCUMENTS

| | | | | |
|---|---|---|---|---|
| 6,230,678 | B1 * | 5/2001 | Gracyalny | F02N 5/02 123/185.14 |
| 6,325,036 | B1 * | 12/2001 | Gracyalny | F02N 5/02 123/185.14 |
| 8,299,639 | B2 * | 10/2012 | Usami | F02N 11/0844 123/179.1 |
| 8,872,373 | B2 * | 10/2014 | Rentschler | F02N 11/087 290/38 R |
| 9,004,034 | B2 * | 4/2015 | Billot | F02N 15/046 123/179.1 |
| 2003/0131817 | A1 * | 7/2003 | Vilou | F02N 15/025 123/179.1 |
| 2010/0026931 | A1 | 2/2010 | Masami et al. | |

FOREIGN PATENT DOCUMENTS

| | | | |
|---|---|---|---|
| EP | 2521854 | A1 | 11/2012 |
| WO | 2013042445 | A1 | 3/2013 |

* cited by examiner

FIG. 1 – Prior Art

FIG. 2 – Prior Art

FIG. 3 – Prior Art

ARRANGEMENT OF SOLENOID ASSEMBLY WITH AN ELECTRONIC SWITCH FOR A STARTER MOTOR

FIELD OF THE INVENTION

The present invention generally relates to starters for a motor vehicle, and particularly relates to a new arrangement of solenoid assembly with an electronic switch for a starter motor.

BACKGROUND OF THE INVENTION

A conventional starter for starting a vehicle engine is designed as shown in FIG. 1

More specifically, the conventional starter device 1, as shown in FIG. 1, comprises: a DC motor 2; an over-running clutch 4 slidably mounted on the output rotary shaft 3 of the motor; an electromagnetic switch 6 provided beside the DC motor 2; and a shift lever 10 having one end engaged with a hook 8 coupled to the plunger 7 of the electromagnetic switch 6 and the other end engaged with the cylindrical rear end portion 9 of the over-running clutch 4 so as to slide the over-running clutch 4 on the output rotary shaft 3.

The electromagnetic switch 6 for operating the shift lever 10 has a cylindrical outer frame 11 which has a wall 11*a* at one end. The aforementioned plunger 7 is inserted into the end wall 11*a*. A stationary iron core 12 is disposed at the other end of the outer frame 11 in such a manner as to confront with the plunger 7. The iron core 12 has an end wall which is fixedly fitted in the rear end portion of the outer frame 11, thus forming a frame together with the outer frame 11. A coil bobbin 13 is accommodated in the frame thus formed. An exciting coil 14 is wound on the coil bobbin 13. A return spring 15 is interposed between the iron core 12 and the plunger 7. The iron core 12 has a central through-hole, into which a rod 16 is slidably inserted in such a manner that its one end portion (or front end portion) is extended from the iron core 12 towards the plunger 7. The other end portion (or rear end portion) of the rod 16 supports a movable contact 17.

The starter further comprises: a carrier rod 18 for returning the rod to a predetermined position; a cap 19 made of resin; and a terminal bolt 20 embedded in the cap 19 so that its inner end serves as a stationary contact with which the movable contact 17 is brought into contact. A magnet 25 connected at the base of the DC motor 2 and a brush box assembly 26 placed in the rear end of the starter motor as protecting device.

The plunger 7 is inserted into the central opening formed in the end wall 11*a* of the outer frame 11, and it is moved along the central axis of the coil bobbin 13 towards the iron core 12. The plunger 7 has a recess which is opened axially outward. The above-described connecting rod 8 is in the form of a piston and has a flange at the rear end. The connecting rod 8 is slid ably inserted into the recess of the plunger 7 and is extended outside passing through the central hole that is formed in a holder 21, which closes the open end of the recess of the plunger 7. The outer end portion of the connecting rod 8 is engaged with the upper end of the shift lever 10. Inside the recess of the plunger 7, a cylindrically coiled spring, namely, a compression spring 22 is interposed between the holder 21 and the flange of connecting rod 8.

The operation of the conventional starter thus constructed will be described in brief.

When the key switch of the vehicle is turned on, the exciting coil 14 of the electro-magnetic switch 6 is energized so that the plunger 7 is moved towards the iron core 12. As a result, the shift lever 10 is turned, whereby the over-running clutch 4 and the pinion 5 integral with the clutch inner portion are slid on the output rotary shaft 3. In this operation, when the pinion 5 abuts against the side of the engine ring gear, the turning of the shift lever 10 is stopped while the plunger 7 continues to move towards the iron core, the compression spring 22 is compressed, so that the pinion is pushed against the engine ring gear through the shift lever 10.

As the plunger 7 pushes the rod, the movable contact 17 is brought into contact with the stationary contact, so that the DC motor 2 is energized. As a result, as soon as the pinion 5 is rotated, it is engaged with the engine ring gear by the elastic force of the compression spring 22.

FIG. 2 describes about the lever 10 in the engaged position with plunger 7 in the solenoid assembly, by this the contactor get connected with the battery terminal. Through this conventional setup the coil energise and the motor starts to crank the vehicle, this operation takes simultaneously.

The conventional solenoid assembly is shown in the FIG. 3 consist of plunger assembly 31 which connects with frame 33 by means of return spring 32. The primary and secondary coils 35 with two leads rounded on a bobbin 34, the plunger strip 36 connects the bobbin and the contact plate 38 though the over travel spring and the other end of the contact plate is connected to the contact return spring 39. The whole solenoid 6 is closed through the cap assembly 41 with a gasket 40 to avoid damages To reduce damage to the pinion, a no-restarting period during which restart is prohibited is required to be set when the engine is rotating in the negative direction. However, as a result of the no-restarting period being set, prompt restarting of the engine becomes difficult to achieve. Usability of the idle stop apparatus is degraded.

OBJECTS OF THE INVENTION

The present invention overcomes the shortcomings associated with the background art and achieves other advantages not realized by the background art.

The principal object of the present invention is to provide a new arrangement of solenoid assembly with an electronic switch for a starter motor, which improves the start in drive performance.

Another object of the present invention about new solenoid arrangement in starter motor that is simply adaptable with the existing starter design without much modification therein.

SUMMARY OF THE INVENTION

The present invention has been achieved in light of the problems of the conventional technology described above. An object of the present invention is to provide a starter capable of preventing damage to a pinion, quickly restarting an engine, and meshing the pinion with the ring gear and restarting the engine even when the engine is rotating in the negative direction during an oscillating period immediately before the engine stops, thereby allowing the engine to be restarted during an overall process of stopping the engine, including during the oscillating period immediately before the engine is stopped.

According to a first aspect of the invention, a starter includes: a motor that generates torque by being energized;

an output shaft that rotates by receiving the torque from the motor; a pinion movable body that includes a pinion for transmitting the torque of the motor to a ring gear of an internal combustion engine, and is provided on an outer circumference of the output shaft integrally with the pinion in a manner allowing movement along an axial direction of the output shaft; a pinion pushing means for pushing the pinion towards the ring gear side; a motor current supply means for turning ON and OFF energizing current flowing to the motor. The motor current-supply means operates separately and independently from the pinion pushing means.

The foregoing objects, the motor is connected through an electronic switch consist of a battery and two switches SW1 and SW2 with a pinion engagement. There are three MOSFETS and six resistors connected accordingly with the motor to close the circuit. Therefore, usability of the idle stop apparatus is enhanced. Life required for a starter used in idle stop having a significantly increased operation frequency can be ensured.

BRIEF DESCRIPTION OF THE DRAWINGS

The present invention will be better understood fully from the detailed description that is given herein below with reference to the accompanying drawings of the preferred embodiments of the present invention, which, however, should not be deemed to be a limitation to the invention to the specific embodiments, but, are for the purpose of explanation and understanding only.

In the drawings.

DETAILED DESCRIPTION OF THE INVENTION

Figure 1:
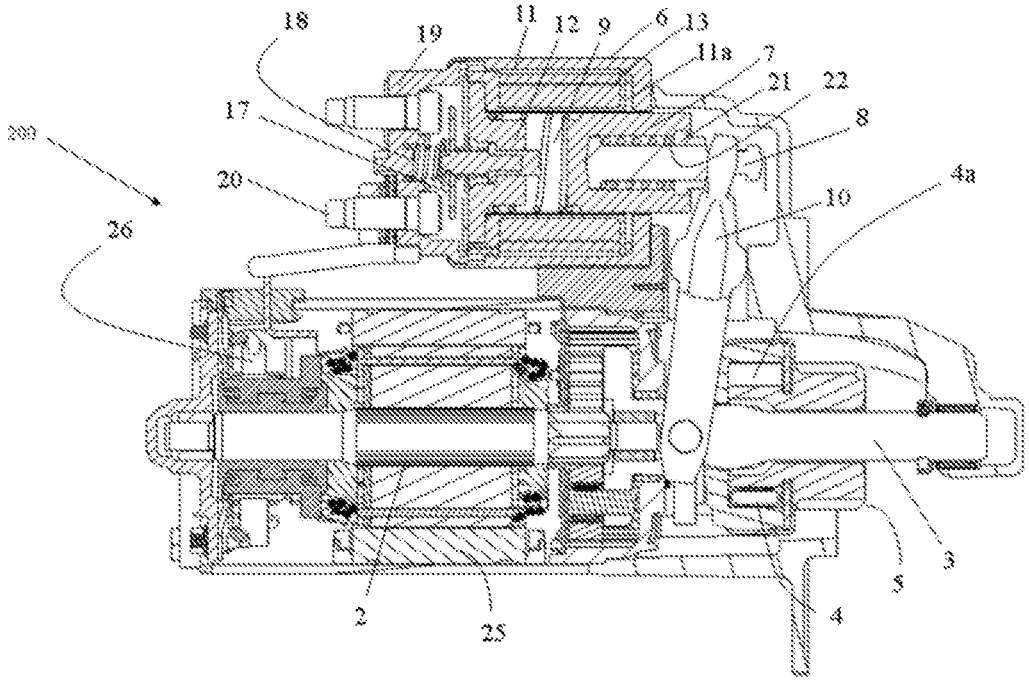
FIG. 1 is a sectional view showing a conventional starter motor in disengaged condition.
Figure 2:
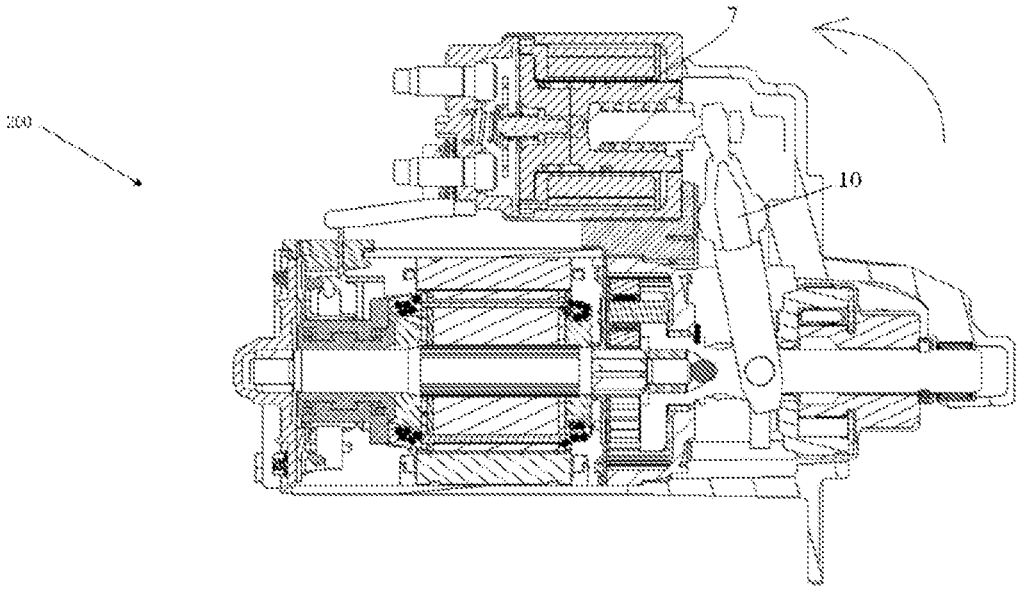
FIG. 2 is a sectional view showing a conventional starter motor in engaged condition.
Figure 3:
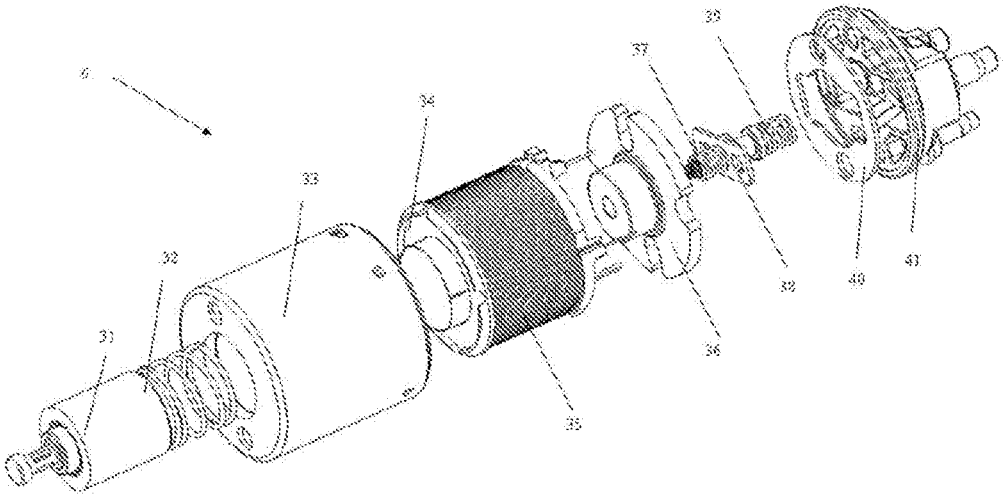
FIG. 3 is an exploded view of conventional solenoid assembly.

While this invention is susceptible of embodiments in many different forms, the detailed description of the preferred embodiments with reference to the corresponding drawings shown herein below are to be understood that the present disclosure shall be deemed as an example of the principles of the invention and not intended to limit the invention to the specific embodiments shown and described. In the description below, like reference numerals are used to describe the same, similar or corresponding parts in the several views of FIG. 4-7.

Figure 4:
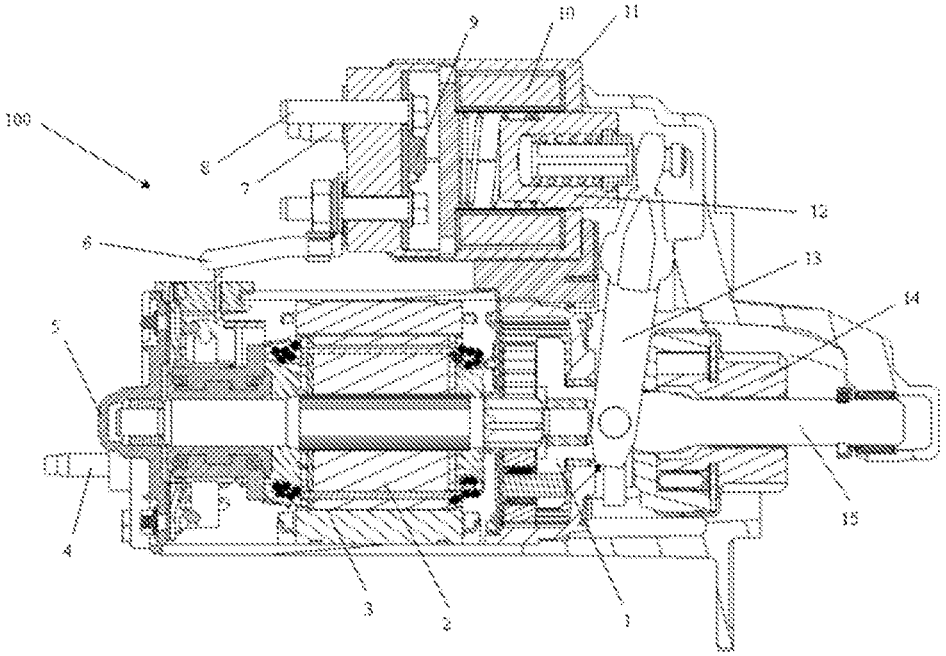
FIG. 4 is a sectional view showing new arrangement of solenoid assembly with electronic switch for starter motor in disengaged position according to this invention.

Referring to FIG. 4, discloses the starter with new arrangement of solenoid assembly, wherein the one end of the output shaft 15 is connected to the armature shaft and the armature shaft is in turn connects to the end plate assembly 5. The output shaft 15 is connected to pinion through drive assembly 1 and the armature assembly 2, the frame assembly 3 is covered on the armature assembly as a protection layer. At the end of the end plate assembly a battery positive terminal B+ve 4. A brush braid 6 which is connected to the solenoid assembly 11, and S+ 7 and battery negative terminal B−ve 8 is also connected to the solenoid assembly. There is an electronic switch 9 which is the newly designed setup in this solenoid, the solenoid coil 10 is surrounded on the plunger 12 and the contact space. The plunger 12 end is connected to the lever 13 which also had a direct connect with pinion 14 of the starter motor.

As shown, the starter according to the embodiment includes an electric motor serving as a power source for driving an engine. The starter also includes a speed reducer, an output shaft, a pinion movable body, a pinion-pushing solenoid, a motor current-supply switch, and a shock absorbing device. The pinion movable body includes a pinion and a clutch. In addition, the longer direction of the starter is the axial direction, the directions which are radially-perpendicular to the axial direction are radial direction, and the rotation direction centring on the axis of the longer direction is a circumferential direction.

The motor receives power supplied from a power supply and rotates, thereby generating torque for starting the engine. The speed reducer is connected to a rotating shaft of the motor and reduces the speed of rotation of the rotating shaft. The output shaft is connected on the output side of the speed reducer. Therefore, the speed of the rotation of the motor is reduced by the speed reducer, and the rotation is transmitted to the output shaft. The pinion is provided on the output shaft such as to be allowed to slide along the output shaft. Therefore, as described hereafter, when the pinion pushing solenoid is driven, the pinion moves towards a ring gear of an internal combustion engine, that is, the pinion moves toward left side in axial direction, and the pinion meshes with the ring gear, the torque of the motor is transmitted to the ring gear by the pinion rotating in the circumferential direction. On the other hand, when the pinion-pushing solenoid is not being driven, the pinion separates from the ring gear of the engine. That is, the pinion moves toward light side in axial direction. In this instance, the torque of the motor is not transmitted to the ring gear.

The pinion movable body is configured integrally with the pinion and disposed on the outer circumference of the output shaft. Using its electromagnetic force, the pinion-pushing solenoid pushes the pinion movable body via a shift lever in a direction moving away from the motor in the axial direction, namely in a direction moving towards the ring gear of the engine. The pinion-pushing solenoid and the shift lever configure a pinion-pushing means.

The motor a brushed direct-current motor including a field magnet, an armature, and a brush. The field magnet is configured by a plurality of permanent magnets. The armature includes an armature shaft. A commutator is provided on one end section of the armature shaft. The brush is disposed such as to be in contact with an outer circumferential surface (referred to as a commutator surface) of the commutator. A brush spring presses the brush against the commutator surface. Instead of the permanent magnets, an electrical magnet configured by a field coil may be used as the field magnet.

Figure 5:
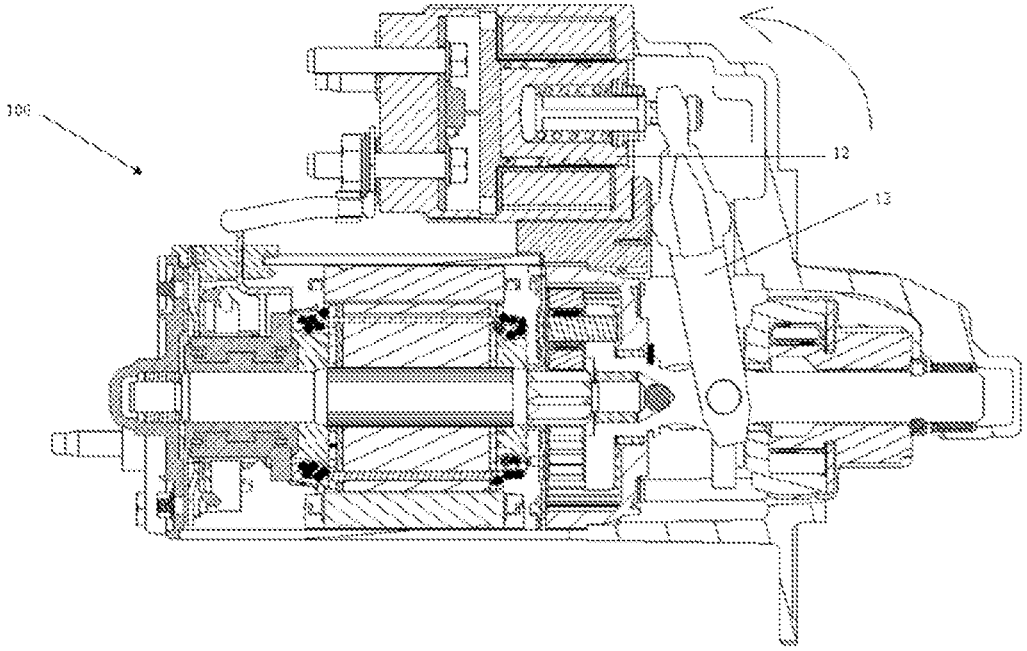
FIG. 5 is a sectional view showing new arrangement of solenoid assembly with electronic switch for starter motor in engaged position according to this invention.

Referring to FIG. 5 discusses about working of starter motor in the engaged position, the power supply from battery connects to the B+ve terminal this energise the brush assembly in the motor, and through brush braid the solenoid activates and the switch opens the circuit. The gate is activated through the power source from vehicle level architecture changes and the plunger pull back to the contact and the lever engages to the pinion and the motor starts running accordingly.

Figure 6:
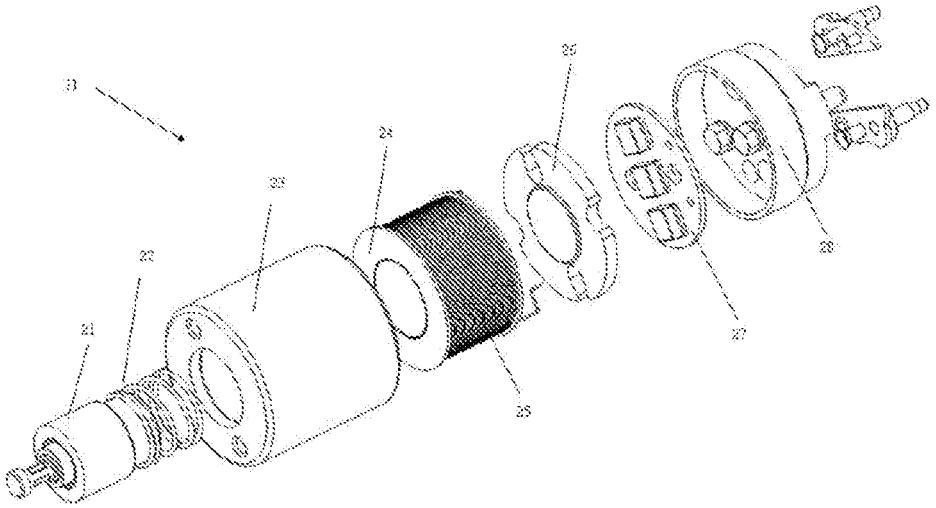
FIG. 6 is an exploded view of new solenoid assembly with an electronic switch.

Referring to FIG. 6, the exploded view new arrangement of solenoid assembly 11, it consist of a plunger assembly 21 with a return spring 22 which is enabled through frame 23. In this arrangement there is single coil 25, not like conventional solenoid which contains two coil as primary and secondary coils. The coil 25 is surrounded on the bobbin assembly 24, there is a plunger strip 26 which connects the electronic circuit assembly 27 and the coil. The whole set of solenoid assembly is covered by a cap assembly 28. This electronic circuit assembly 27 is used to drive a motor alone and the adjacent side of solenoid such as coil 25 and plunger strip 26 which is for drive assembly activation process.

Figure 7:
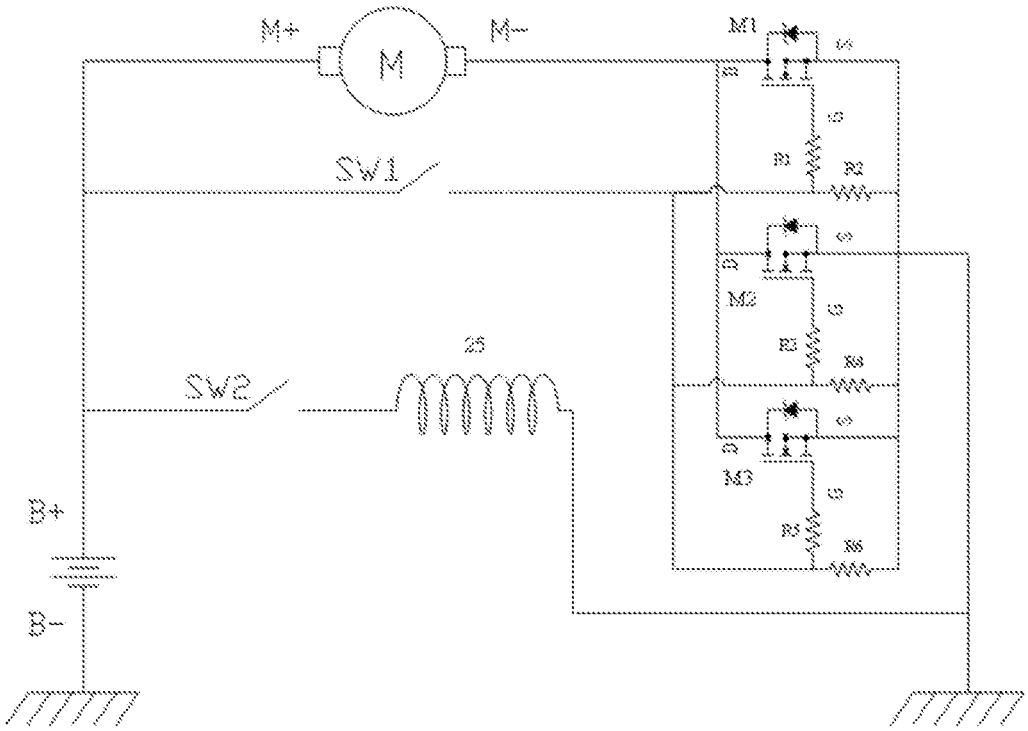
FIG. 7 is a circuit diagram for an electronic switch used in the solenoid assembly.

The electronic circuit assembly 27 of the new solenoid arrangement is explained in FIG. 7, consist of battery with two terminal B+ and B−, further the B−ve is grounded and B+ve connected to the coil 25 through a switch SW2 and the other end of the coil 25 is grounded to close the circuit, this setup used convert the electric movement to linear movement for pulling up the drive of solenoid assembly. And the end of the battery connects to MOSFETs and resistors through and another switch SW1. There are three MOSFETs M1, M2 and M3 which is connected to the resistors R1 to R6 respectively to operate the motor brush M− and M+ is connected to the batter source via SW1. This part of the electronic circuit is used to motor specifically. This type of new solenoid is effective in the start in drive arrangements and the solenoid life time will be increased up to a level. Hence, the preferred embodiment disclosed in the foregoing description should not construed as a limitation to the scope of the present invention.

It will be readily appreciated by those skilled in the art that modifications may be made to the invention without departing from the concepts disclosed in the foregoing description. Accordingly, the preferred embodiments described in detail herein are illustrative only and are not limiting to the scope of the invention, which is to be given the full extent of the appended claims.

The invention claimed is:

1. A solenoid assembly for a starter motor comprising: a plunger assembly having a return spring which is enabled through a frame, and a bobbin assembly, said solenoid assembly further comprises a single solenoid coil and an electronic circuit, said electronic circuit consisting of a plurality of MOSFETs, the MOSFETSs being arranged in parallel, a first resistor coupled to a source of each of the MOSFETS, a second resistor coupled a drain of each of the MOSFETs, said bobbin assembly is surrounded by said single solenoid coil, a first switch being connected to a battery, the first switch connects the MOSFETs and the first resistor and the second resistor of each of the MOSFETs to the single solenoid coil, a second switch being connected to the battery and the drive assembly, wherein said solenoid assembly separately actuates said electronic circuit by actuating the first switch for energizing the starter motor and said solenoid coil and the second switch for activating a drive assembly.

2. The solenoid assembly as claimed in claim 1, wherein said single solenoid coil and said electronic circuit are connected through a plunger strip.

3. The solenoid assembly as claimed in claim 1, wherein said solenoid assembly is covered by a cap assembly.

* * * * *